United States Patent [19]

Olbrich et al.

[11] Patent Number: 4,502,945

[45] Date of Patent: Mar. 5, 1985

[54] PROCESS FOR PREPARING OLEFINS AT HIGH PRESSURE

[75] Inventors: Hazel C. Olbrich, Rodeo; Dennis J. O'Rear, Petaluma, both of Calif.

[73] Assignee: Chevron Research Company, San Francisco, Calif.

[21] Appl. No.: 386,551

[22] Filed: Jun. 9, 1982

[51] Int. Cl.[3] ..... C10G 11/05; C10G 11/02; C07C 4/06

[52] U.S. Cl. ..... 208/120; 585/648

[58] Field of Search ..... 208/120; 585/648, 651, 585/654

[56] References Cited

U.S. PATENT DOCUMENTS

| | | | |
|---|---|---|---|
| 3,404,086 | 10/1968 | Plank et al. | 208/120 |
| 3,700,585 | 10/1972 | Chen et al. | 208/DIG. 2 |
| 3,758,403 | 9/1973 | Rosinski et al. | 208/75 X |
| 4,107,032 | 8/1978 | Chester | 208/113 X |
| 4,251,348 | 2/1981 | O'Rear et al. | 208/120 |
| 4,282,085 | 8/1981 | O'Rear et al. | 208/120 |
| 4,309,275 | 1/1982 | Mulasky | 585/648 |
| 4,330,396 | 5/1982 | Miller | 208/136 |
| 4,340,465 | 7/1982 | Miller et al. | 208/120 |

*Primary Examiner*—Delbert E. Gantz
*Assistant Examiner*—Glenn A. Caldarola
*Attorney, Agent, or Firm*—S. R. La Paglia; W. L. Stumpf; V. J. Cavalieri

[57] ABSTRACT

A highly efficient process for producing olefins using intermediate pore size zeolites is disclosed. The use of a specific range of silica:alumina mole ratios (175:1 to about 300:1) at pressure over 30 psia has been found to decrease catalyst deactivation rates for these intermediate pore size catalysts.

6 Claims, 4 Drawing Figures

PROCESS FOR PREPARING OLEFINS AT HIGH PRESSURE

TECHNICAL BACKGROUND

This invention relates to hydrocarbon conversion processes which use intermediate pore size molecular sieves. In particular, the invention relates to the selective conversion of normal and slightly branched paraffins into a lower molecular weight product mixture containing substantial amounts of olefins.

Straight chain and slightly branched chain paraffins are components of both natural and synthetic hydrocarbonaceous feeds. The presence of these compounds is often undesirable. To high-boiling oil fractions they give high pour points and to lower boiling fractions they give low octane numbers.

Many paraffin removal techniques have been reported in the literature. The product of these processes, where crystalline zeolites are used, is often a light paraffinic gas. This gas is not particularly reactive or valuable so it is burned in the refinery or used as LPG fuel. (U.S. Pat. No. Re. 28,398, Chen et al., Apr. 22, 1975—dewaxing with ZSM-5-type zeolites.) In other hydrodewaxing processes, the zeolite performance is improved by controlling the activity as measured by the alpha index (U.S. Pat. No. 4,247,388, Banta et al., Jan. 27, 1981).

Processes which produce more reactive and valuable olefins have been proposed. These processes require low pressures to prevent the catalyst from hydrogenating the product olefins; ZSM-5-type catalysts are used. (U.S. Pat. No. 4,171,257, O'Rear et al., Oct. 16, 1979; U.S. Pat. No. 4,251,348, O'Rear et al., Feb. 17, 1981; U.S. Pat. No. 4,282,085, O'Rear et al., Aug. 4, 1981.)

Further research into the characteristics of intermediate pore size materials has revealed that low aluminum content materials, such as those disclosed in U.S. Pat. No. 4,061,724, Grose et al., Dec. 6, 1977, and U.S. Pat. No. Re. 29,948, Dwyer et al., Mar. 27, 1979, have catalytic activity and can produce olefins from paraffins. See U.S. Pat. No. 4,309,275, Mulaskey, Jan. 5, 1982; U.S. Pat. No. 4,309,276, Miller, Jan. 5, 1982.

We have discovered a surprising relationship between pressure and silica:alumina mole ratio of the zeolite for olefin preparation reactions which use intermediate pore size materials. Our discoveries lead to a highly efficient process for producing olefins from paraffins.

TECHNICAL DISCLOSURE

Figure 1:
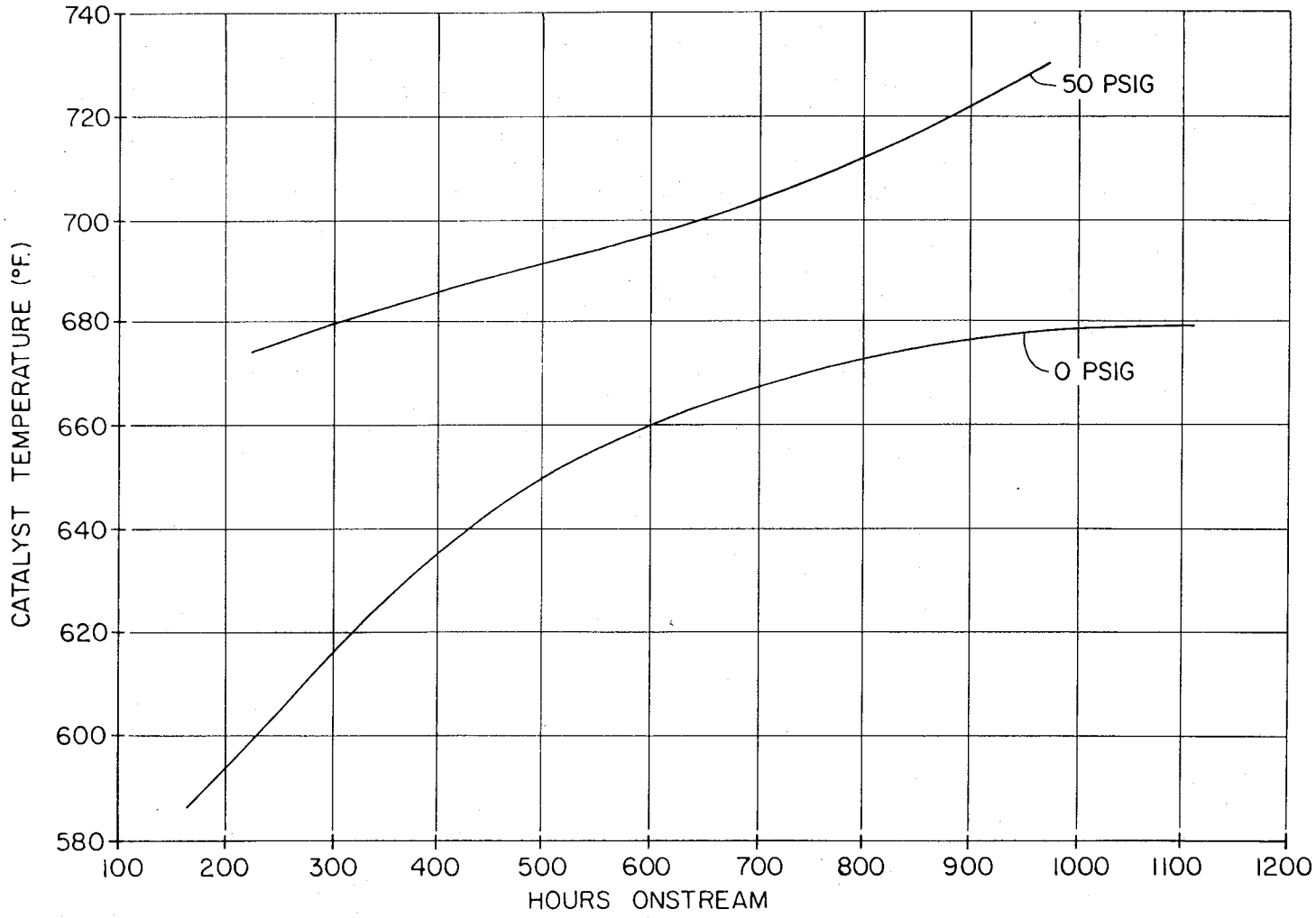
FIG. 1 illustrates the data of Example 1.

Our discoveries are embodied in a process for producing olefins from normal paraffins, slightly branched paraffins and mixtures thereof, comprising contacting a feed, which comprises said paraffins, with a catalyst, which comprises an intermediate pore size, silicaceous crystalline molecular sieve having a silica:alumina mole ratio from about 150:1 to about 500:1, under olefin-producing reaction conditions comprising a pressure from about 30 psia (2.07 bar) to about 115 psia (7.9 bar).

The hydrocarbonaceous feed can be any hydrocarbon containing material which it is desired to dewax. Examples include naphtha, reformate, kerosene, diesel fuel, heating fuel, jet fuel, gas oil and lube oil stocks. Those hydrocarbon feeds boiling above 200° C. are particularly suitable as they are typically subjected to dewaxing processes to remove paraffins, to lower pour and freeze points, and to produce lube oils and middistillate fuels. Preferably, the feed contains at least 5 weight percent normal and slightly branched paraffins, and more preferably above about 10 percent normal and slightly branched chain paraffins. Typical feeds contain from about 5 to 40 weight percent, and more preferably from about 10 to 30 weight percent, normal and slightly branched chain paraffins.

The presence of nitrogen compounds in the feed tends to lead to a reduction of the catalyst's activity and a shortening of the run life. For this reason, it is preferred that the total feed nitrogen be reduced to less than about 50 ppm by weight, and more preferably less than about 10 ppm by weight total nitrogen. It is also preferred that the feed have a sulfur content of less than about 100 ppm by weight organic sulfur, and preferably less than about 50 ppm by weight organic sulfur. An ideal feed is all or part of the effluent of a hydrocracker, particularly the normally liquid effluent, since hydrocracking converts organonitrogen and organosulfur compounds to gaseous nitrogen and sulfur compounds which are removed before the feed is further processed.

One of the benefits of earlier processes is that large quantities of olefins can be produced using intermediate pore size materials of relatively high aluminum content, e.g., ZSM-5. The disadvantage to these processes is that they tend to become increasingly inefficient, producing fewer olefins, as the pressure in the olefin production zone increases; and so low pressure operation is most preferred and efficient. But in the refinery, higher pressure operation is preferred, since the olefins produced by a low pressure operation must be compressed for further handling. It can be appreciated that compressors are expensive to build and operate. Other processes which would allow the production of olefins under pressure tend to have higher fouling rates at high pressures than at low pressures. Lower pressure operation is preferred for efficient operation—longer run length—even though higher pressures are preferred for the refinery.

We have discovered that there is an unusual relationship between the pressure in the reaction zone and the aluminum content of the molecular sieve which gives a region of highly preferred olefin-producing activity. The conditions in the reaction zone can include standard hydroprocessing temperatures and flow rates. The temperature typically ranges from about 290° C. to about 595° C., more preferably from about 340° C. to about 480° C., while the liquid hourly space velocity can range from about 0.1 to about 50 v/v/hr, preferably from about 0.5 to about 25 v/v/hr.

The pressure, however, can range from about 30 psia (2.07 bar) to about 115 psia (7.9 bar), preferably from about 45 psia (3.1 bar) to about 90 psia (6.2 bar), and most preferably from about 55 psia (3.8 bar) to about 75 psia (5.2 bar). The silica:alumina mole ratio of the molecular sieve, as will be described, can range from about 150:1 to about 500:1, more preferably from about 175:1 to about 300:1, and most preferably from about 210:1 to about 270:1. Within these ranges, surprisingly long run lives and high olefin production rates can be achieved. Other reaction conditions which allow increased selectivity to propylene are disclosed in copending application Ser. No. 386,552, filed June 9, 1982, incorporated by reference.

By "intermediate pore size silicaceous crystalline molecular sieve," as used herein, is meant two classes of silica-containing crystalline materials. The first class includes materials which, in addition to silica, contain significant amounts of alumina. These crystalline materials are usually called "zeolites," i.e., crystalline aluminosilicates. The second class of materials are essentially alumina-free silicates. These crystalline materials can include crystalline silica polymorphs, e.g., silicalite, chromia silicates, e.g., CZM, and ferrosilicates, e.g., U.S. Pat. No. 4,238,318.

All of these materials have the ability of sorting molecules based on the size or the shape, or both of the molecules. The larger pore size materials will admit larger molecules than the smaller pore size materials. Intermediate pore size silicaceous crystalline molecular sieves have the unique characteristics of being able to differentiate between large molecules and molecules containing quaternary carbon atoms on the one hand, and smaller molecules on the other hand. Thus, the intermediate pore size materials have surprising catalytic selectivities by reason of their effective pore apertures, as well as highly desirable and surprising catalytic activity and stability when compared to the larger pore size crystalline molecular sieves.

By "intermediate pore size," as used herein, is meant an effective pore aperture in the range of about 5 to 6.5 Angstroms when the molecular sieve is in the H-form. Molecular sieves having pore apertures in this range tend to have unique molecular sieving characteristics. Unlike small pore size zeolites such as erionite and chabazite, they will allow hydrocarbons having some branching into the molecular sieve void spaces. Unlike larger pore size zeolites such as the faujasites, they can differentiate between n-alkanes and slightly branched alkanes on the one hand and larger branched alkanes having, for example, quaternary carbon atoms.

The effective pore size of the molecular sieves can be measured using standard adsorption techniques and hydrocarbonaceous compounds of known minimum kinetic diameters. See Breck, *Zeolite Molecular Sieves,* 1974 (especially Chapter 8) and Anderson et al., J. Catalysis 58, 114 (1979), both of which are incorporated by reference.

Intermediate pore size molecular sieves in the H-form will typically admit molecules having kinetic diameters of 5.0 to 6.5 Angstroms with little hindrance. Examples of such compounds (and their kinetic diameters in Angstroms) are: n-hexane (4.3), 3-methylpentane (5.5), benzene (5.85), and toluene (5.8). Compounds having kinetic diameters of about 6 to 6.5 Angstroms can be admitted into the pores, depending on the particular sieve, but do not penetrate as quickly and in some cases are effectively excluded. Compounds having kinetic diameters in the range of 6 to 6.5 Angstroms include: cyclohexane (6.0), 2,3-dimethylbutane (6.1), m-xylene (6.1), and 1,2,3,4-tetramethylbenzene (6.4). Generally, compounds having kinetic diameters of greater than about 6.5 Angstroms do not penetrate the pore apertures and thus are not absorbed into the interior of the molecular sieve lattice. Examples of such larger compounds include: hexamethylbenzene (7.1), 1,3,5-trimethylbenzene (7.5), and tributylamine (8.1).

The preferred effective pore size range is from about 5.3 to about 6.2 Angstroms. Among the materials falling within this range are the zeolite ZSM-5, the crystalline silica polymorph silicalite, RE 29,948 organosilicates, and the chromia silicate, CZM.

In performing adsorption measurements to determine pore size, standard techniques are used. It is convenient to consider a particular molecule as excluded if it does not fill at least 80% of the zeolite pore volume in less than about one hour (p/po=0.5; 25° C.).

Examples of intermediate pore size silicaceous crystalline molecular sieves include zeolites such as members of the ZSM series, e.g., ZSM-5, ZSM-11, ZSM-12, ZSM-21, ZSM-23, ZSM-35, ZSM-38, and ZSM-48. ZSM-5 is described in U.S. Pat. Nos. 3,702,886 and 3,770,614; ZSM-11 is described in U.S. Pat. No. 3,709,979; ZSM-12 is described in U.S. Pat. No. 3,832,449; ZSM-21 and ZSM-38 are described in U.S. Pat. No. 3,948,758; ZSM-23 is described in U.S. Pat. No. 4,076,842; ZSM-35 is described in U.S. Pat. No. 4,016,245; ZSM-48 is disclosed in EP No. 15,132, published Sept. 3, 1980. These patents and specifications are incorporated herein by reference. The intermediate pore size materials can include "crystalline admixtures" which are thought to be the result of faults occurring within the crystal or crystalline area during the synthesis of the zeolites. The "crystalline admixtures" are themselves zeolites but have characteristics in common, in a uniform or nonuniform manner, to what the literature reports as distinct zeolites. Examples of crystalline admixtures of ZSM-5 and ZSM-11 are disclosed and claimed in U.S. Pat. No. 4,229,424, Kokotailo, Oct. 21, 1980 (incorporated by reference). The crystalline admixtures are themselves intermediate pore size zeolites and are not to be confused with physical admixtures of zeolites in which distinct crystals or crystallites of different zeolites are physically present in the same catalyst composite or hydrothermal reaction mixtures.

Other examples of intermediate pore size silicaceous crystalline molecular sieves include silicalite, as disclosed in U.S. Pat. No. 4,061,724, and "U.S. Pat. No. Re. 29,948 organosilicates," as disclosed in U.S. Pat. No. Re. 29,948. Intermediate pore size silicas, ferrosilicates and galliosilicates are disclosed in U.S. Pat. No. 4,238,318, Kouwenhoven et al., Dec. 9, 1980. Intermediate pore size chromia silicates, CZM, are disclosed in U.S. Ser. No. 160,618, Miller, filed June 28, 1980. All of these are incorporated by reference.

The most preferred molecular sieves are those which have the crystal structure and exhibit the X-ray diffraction pattern characteristic of ZSM-5, ZSM-11, and their crystalline admixtures, silicalite, U.S. Pat. No. Re. 29,948 organosilicates, and the chromia silicate, CZM. These materials will have silica:alumina mole ratios of from about 150:1 to about 500:1, preferably from about 175:1 to about 300:1, and more preferably from about 210:1 to about 270:1. It can be appreciated that these mole ratios are higher than the typical "ZSM-5 zeolite" and lower than the typical "silicalite silicate."

The molecular sieve can be in any convenient form for ordinary fixed bed, fluidized bed or slurry use. Preferably it is used in a fixed bed reactor and in a composite with a porous inorganic binder or matrix in such proportions that the resulting product contains from 1 to 95 percent by weight and preferably from 10 to 70 percent by weight of molecular sieve in the final composite.

The terms "matrix" and "porous matrix" include inorganic compositions with which the molecular sieve can be combined, dispersed, or otherwise intimately admixed. The matrix should not be catalytically active in a cracking sense, i.e., it should contain substantially no acid sites, and it should have substantially no hydrogenation activity. The porosity of the matrix can either be inherent in a particular material or it can be caused by a mechanical or chemical means. Representative matrix materials include pumice, firebrick, diatomaceous earth and inorganic oxides. Representative inorganic oxides include alumina, silica, naturally occurring and conventionally processed clays, for example, attapulgite, sepiolite, bentonite, and kaolin. The preferred matrices have few, if any, acid sites and little or no cracking activity. Silica and alumina are especially preferred.

The compositing of the molecular sieve with the inorganic oxide matrix can be achieved by any suitable method wherein the sieve is intimately admixed with the oxide. Typical compositing procedures known to the art include cogelling and comulling.

The use of a non-acidic matrix is highly preferred for maximizing olefin production. Olefins are especially desirable and are valuable for many well known uses in the petroleum and chemical processing arts, whereas their chemically less reactive alkane counterparts are far less desirable products. The yield of olefins will vary depending upon the particular feed composition, form of the sieve and reaction conditions used. As used herein, "substantial olefin fraction" means that the converted hydrocarbons will contain at least 10 weight percent olefins, preferably at least 30 weight percent olefins, more preferably at least 50 weight percent olefins, and most preferably at least 70 weight percent olefins. "Converted hydrocarbons" means that portion of the hydrocarbon product which boils below the initial boiling point of the feed.

EXAMPLE 1

A series of experiments was performed to investigate the effect of pressure on the stability of a ZSM-5 zeolite to fouling while producing olefins. The feed had the following characteristics:

| | |
|---|---|
| Gravity, °API | 35.5 |
| Nitrogen, ppm | 0.31 |
| Sulfur, ppm | 5.4 |
| Pour Pt., °C. | 12 |
| P/N/A | 41.8/48.4/9.8 |
| Distillation (D-1160), °C.: | |
| St/5 | 257/270 |
| 10/20 | 281/308 |
| 50 | 332 |
| 70/90 | 354/382 |
| 95/EP | 388/389 |

Reaction conditions included fixed bed operation, LHSV of 6.0 and temperature sufficient to maintain conversion at 15 weight percent of feed to less than 350° F. (177° C.). The ZSM-5 zeolites had a silica:alumina mole ratio of 71:1. The data obtained for this life test are illustrated in FIG. 1. Two sequences were performed, one at 0 psig (14.7 psia, 1.01 bar) and the second at 35–50 psig (49.7–64.7 psia, 2.41–3.45 bar). The data show that the production of olefins at a higher pressure using the ZSM-5-type material is not only less efficient (a higher temperature is necessary to obtain the same conversion) but also the catalyst is less stable, it fouled more rapidly.

EXAMPLE 2

Figure 2:
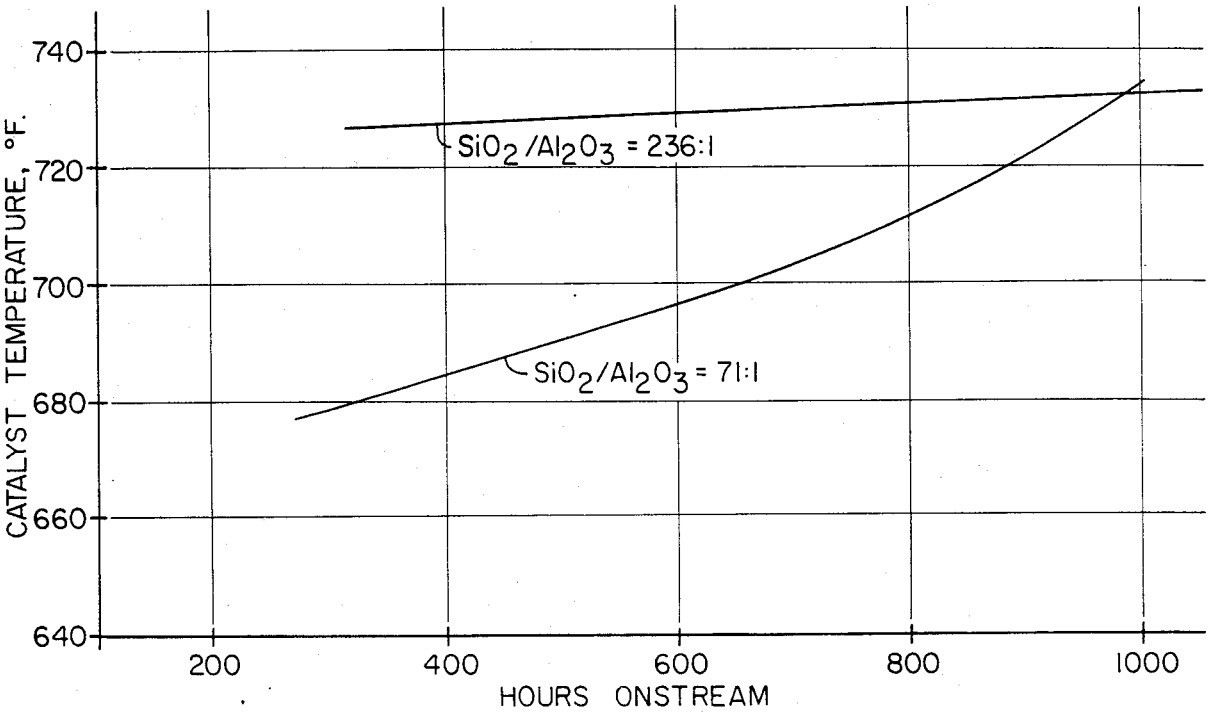
FIG. 2 illustrates the data of Example 2.

A series of experiments was performed to examine the effect of pressure on a silicalite-type material having a silica:alumina mole ratio of 236:1. The feed was the same as in Example 1. Reaction conditions included LHSV of 6.0 and temperature to maintain 15 weight percent conversion to below 350° F. (177° C.). A run started at 100 psig (113.7 psia, 7.92 bar) fouled very rapidly and was discontinued. A second run at 50 psig (64.7 psia, 3.45 bar) was performed successfully. The stability of the catalyst is illustrated in FIG. 2 and is contrasted with the results of Example 1 at 50 psig (64.7 psia, 4.47 bar). A third experiment at 0 psig (14.7 psia, 1.01 bar) was also performed. The data (below) also show that the amount of $C_3$ and $C_4$ olefins produced remained relatively constant for the silicalite-like material but decreased by over 50 percent for the ZSM-5 material:

| | $C_3$ and $C_4$ Olefins Produced, Weight Percent of Feed | |
|---|---|---|
| $SiO_2$:$Al_2O_3$ Mole Ratio | 0 psig (1.01 bar) | 50 psig (3.45 bar) |
| 71 | 6.60 | 3.14 |
| 236 | 4.43 | 4.06 |

EXAMPLE 3

Figure 3:
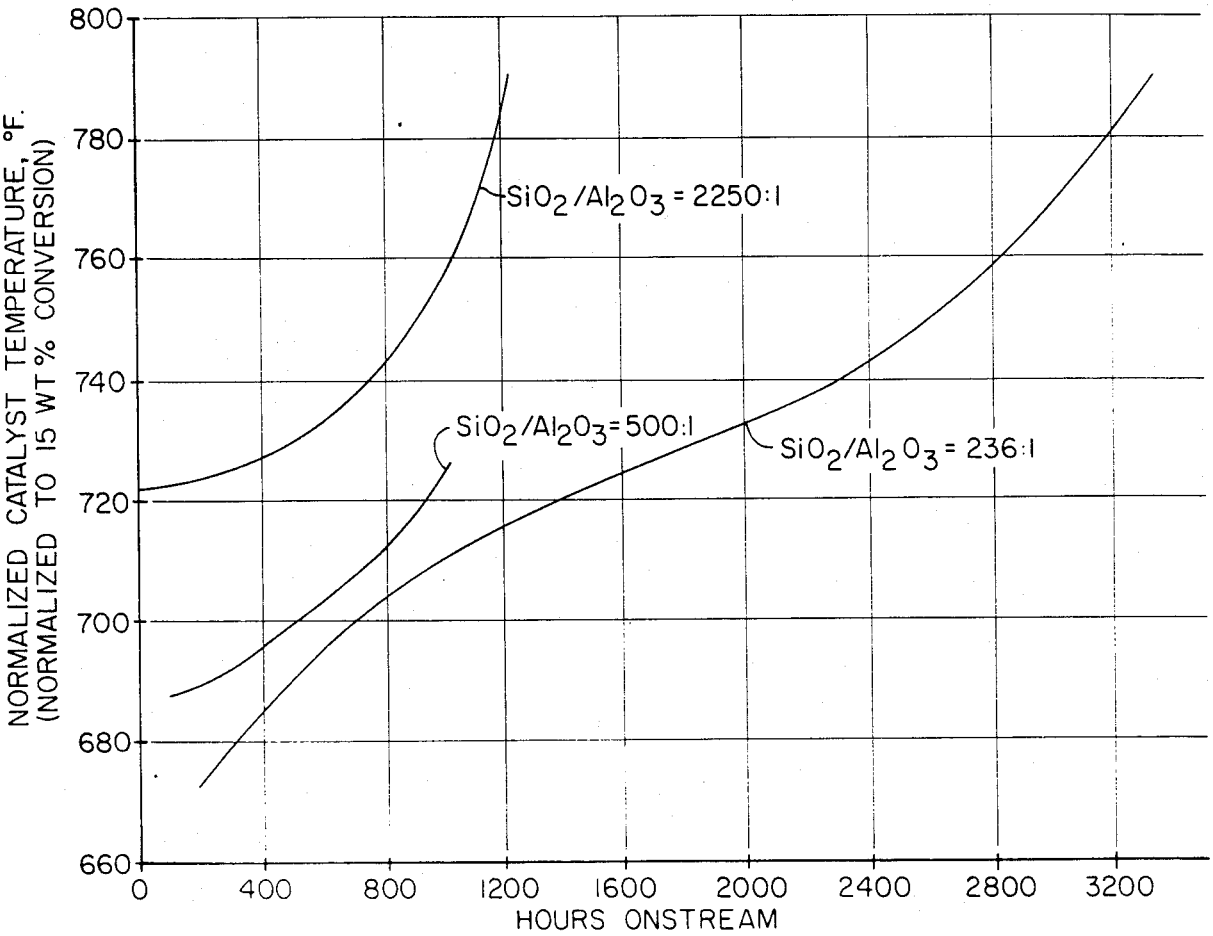
FIG. 3 and FIG. 4 illustrate the data of Example 3.
Figure 4:
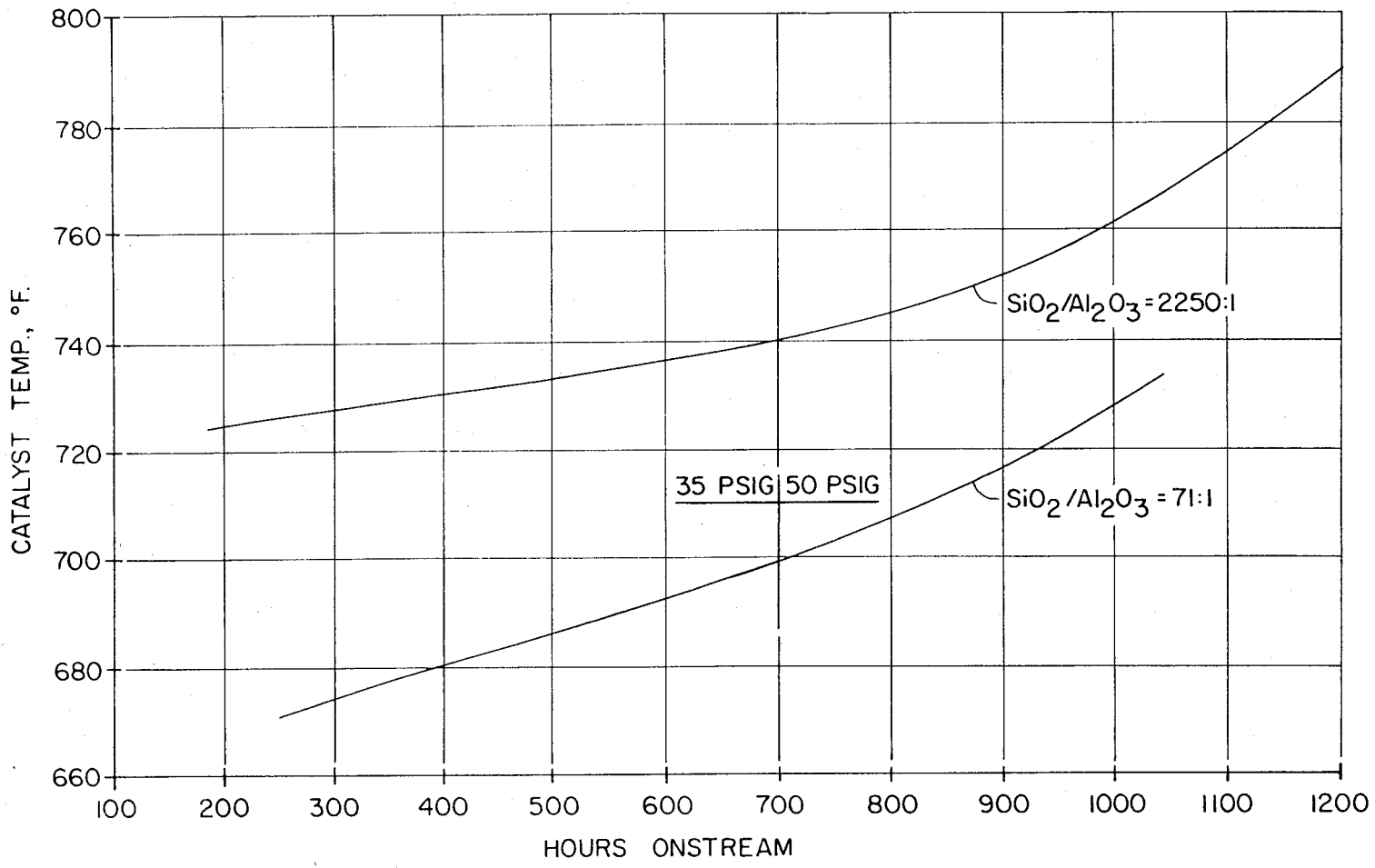

Three further experiments were performed to examine the effect of silica:alumina mole ratio on catalyst life for olefin production. The same feed was used as in Examples 1 and 2 and other reaction conditions included LHSV of 6.0 and temperature to maintain conversion at 15 weight percent of feed to less than 350° F. One catalyst tested was a silicalite-range material having a silica:alumina mole ratio of 2250:1, the second had a silica:alumina mole ratio of 500:1, the third repeated the experiment with a 236:1 material. The pressure was 50 psig (64.7 psia, 4.47 bar). The results are shown in FIG. 3. As is evident from the data, the very high silica:alumina material is inactive and very unstable. While the 500:1 material is much more desirable than the very high silica material, its stability is not as great as that of the 236:1 material. FIG. 4 compares the catalyst stability of the very high silica material to a ZSM-5-range zeolite of 71:1 silica:alumina mole using the same conditions, except for an initial pressure of 35 psig (49.7 psia, 3.45 bar). Although the ZSM-5 material was more active, the stability was as poor as the high silica material.

What is claimed is:

1. A process for producing olefins from normal paraffins, slightly branched paraffins and mixtures thereof, comprising contacting a feed, which comprises said paraffins, with a catalyst, which comprises an intermediate pore size silicaceous crystalline molecular sieve having a silica:alumina mole ratio from about 175:1 to about 300:1, under olefin-producing reaction conditions comprising a pressure from about 30 psia (2.07 bar) to about 115 psia (7.9 bar).

2. The process of claim 1 wherein said silica:alumina mole ratio is from about 210:1 to about 270:1.

3. The process of claim 1 wherein said pressure is from about 45 psia (3.1 bar) to about 90 psia (6.2 bar).

4. The process of claim 3, wherein said pressure is from about 55 psia (3.8 bar) to about 75 psia (5.2 bar).

5. The process of claim 1, 2, 3, or 4 wherein said molecular sieve has the X-ray diffraction pattern of ZSM-5.

6. The process of claim 1 wherein said feed has a total nitrogen content of less than about 50 ppm by weight.

* * * * *